US006645037B1

(12) United States Patent
Choi

(10) Patent No.: US 6,645,037 B1
(45) Date of Patent: Nov. 11, 2003

(54) PROGRAMMABLE TOY AND GAME

(75) Inventor: Kei Fung Choi, Hong Kong (HK)

(73) Assignee: Silverlit Toy Manufactory Ltd., Hong Kong (CN)

( * ) Notice: Subject to any disclaimer, the term of this patent is extended or adjusted under 35 U.S.C. 154(b) by 0 days.

(21) Appl. No.: 09/140,060

(22) Filed: Aug. 12, 1998

(51) Int. Cl.[7] ..... A63H 17/00
(52) U.S. Cl. ..... 446/436; 446/431; 446/409
(58) Field of Search ..... 496/436, 457, 496/460, 431, 437, 438, 397, 409; 701/36; 180/204

(56) References Cited

U.S. PATENT DOCUMENTS

| | | | | |
|---|---|---|---|---|
| 3,840,086 A | * | 10/1974 | Burton | 446/460 X |
| 4,198,620 A | | 4/1980 | Vogt et al. | |
| 4,201,012 A | | 5/1980 | Marshall | |
| 4,208,654 A | | 6/1980 | Vogt et al. | |
| 4,390,877 A | | 6/1983 | Curran | |
| 4,480,401 A | | 11/1984 | Matsushiro | |
| 4,654,659 A | * | 3/1987 | Kubo | 340/825.76 |
| 4,662,854 A | | 5/1987 | Fang | |
| 4,702,718 A | | 10/1987 | Yanase | |
| 4,712,184 A | * | 12/1987 | Haugerud | 364/513 |
| 4,754,133 A | | 6/1988 | Bleich | |
| 4,767,376 A | * | 8/1988 | Hanzawa | 446/457 |
| 4,813,907 A | | 3/1989 | Rissman et al. | |
| 4,907,804 A | | 3/1990 | Arad et al. | |
| 5,100,153 A | | 3/1992 | Welte | |
| 5,147,237 A | | 9/1992 | Kwan et al. | |
| 5,334,075 A | * | 8/1994 | Kakizaki et al. | 446/438 |
| 5,474,486 A | | 12/1995 | Chilton et al. | |
| 5,481,257 A | | 1/1996 | Brubaker et al. | |
| 5,697,829 A | | 12/1997 | Chainani et al. | |
| 5,723,855 A | | 3/1998 | Oh et al. | |

FOREIGN PATENT DOCUMENTS

DE 2259915 12/1972

OTHER PUBLICATIONS

"Buddy L Ready, Set Go" published by SLM, Inc. 1993.*
"OWI expands its line of do–it–yourself multi–market robots"; The Toy Book; Feb. 1991; p. 94.
"Heath's HERO–1 Robot", BYTE Publications Inc.; Jan. 1983; pp. 86–96.

* cited by examiner

*Primary Examiner*—Sam Rimell
(74) *Attorney, Agent, or Firm*—Charles Berman; Claude Nassif; Greenberg Traurig LLP

(57) ABSTRACT

A programmable device such as a toy or novelty item has a keyboard which can be activated by a user to set up any one or multiple different motions of the toy. Sounds and lights can be activated to coordinate with the movement. The toy can be a car or other device capable of moving in the environment. The keyboard can also be used to play a game of skill, for instance, shooting at a target.

22 Claims, 15 Drawing Sheets

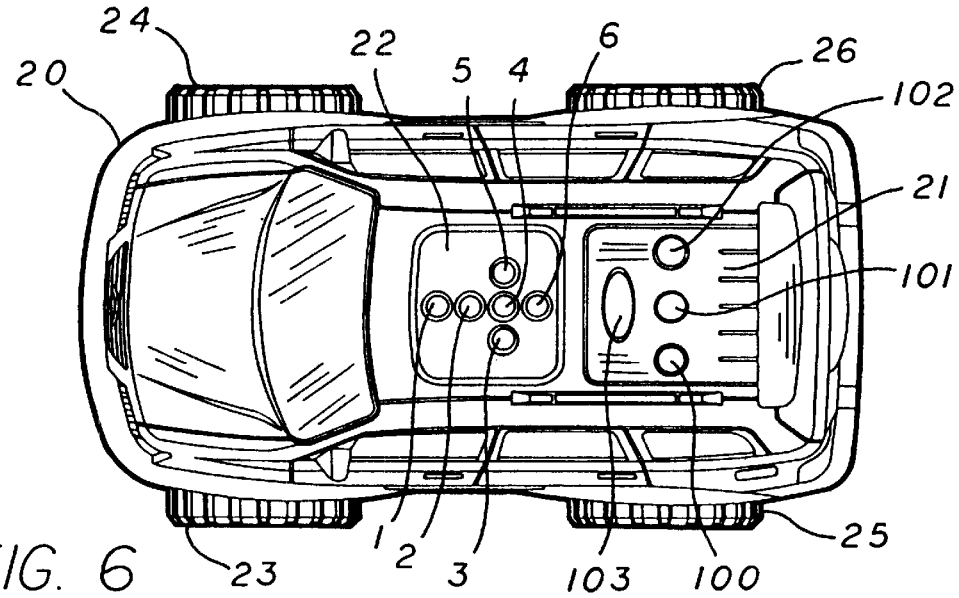
FIG. 6
FIG. 7
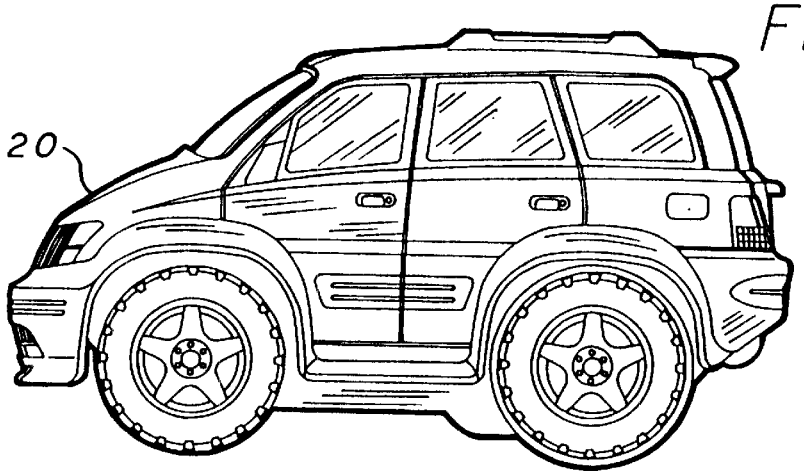
FIG. 8
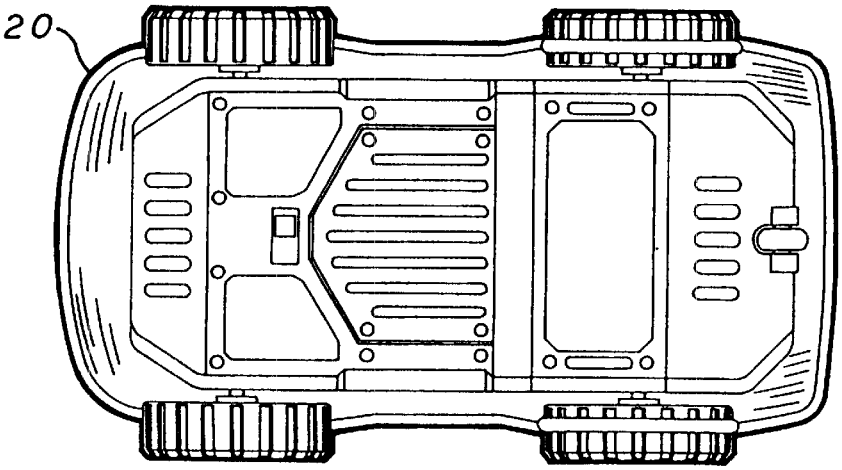

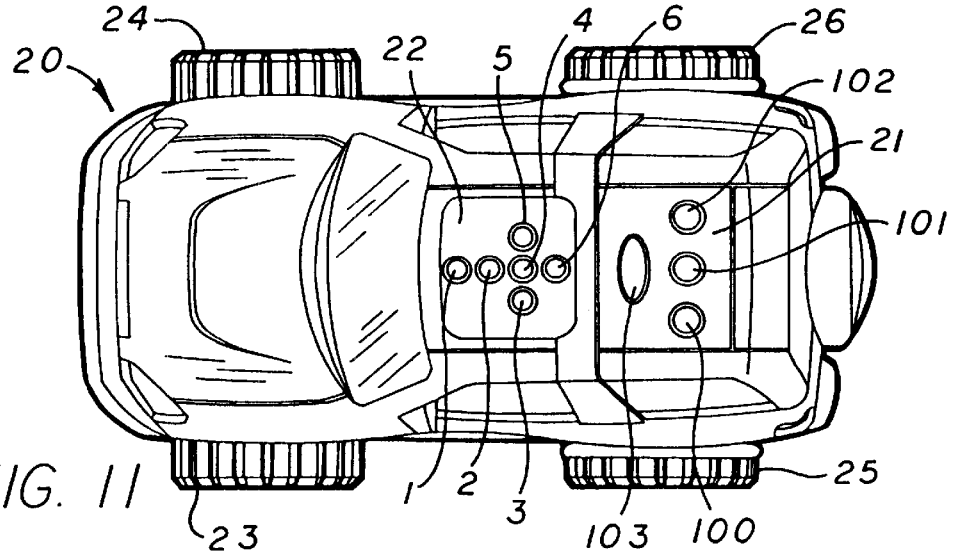
FIG. 11
FIG. 12
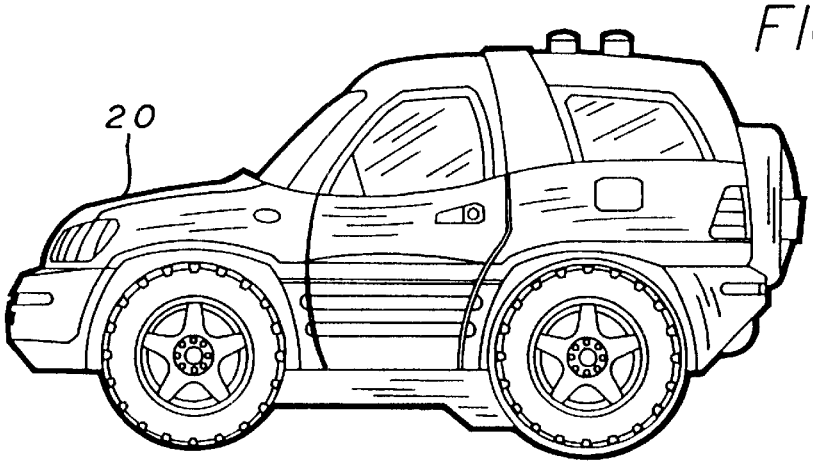
FIG. 13
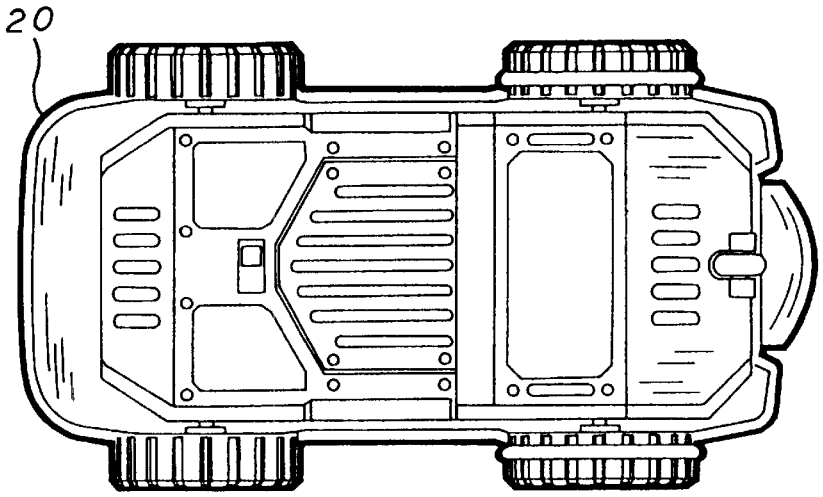

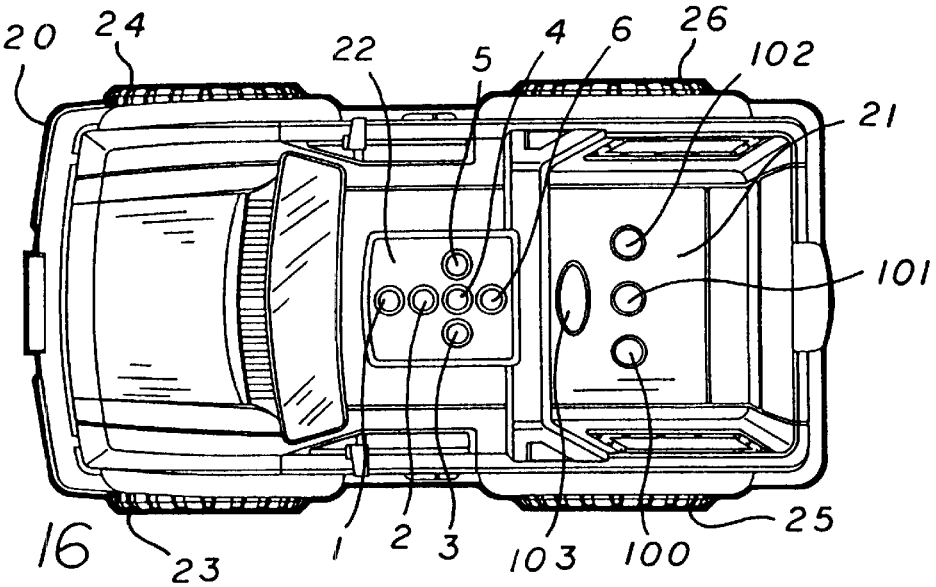
FIG. 16
FIG. 17
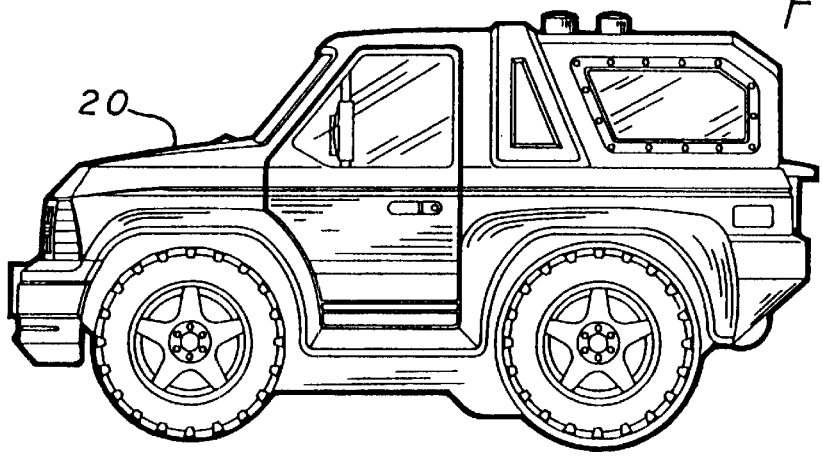
FIG. 18
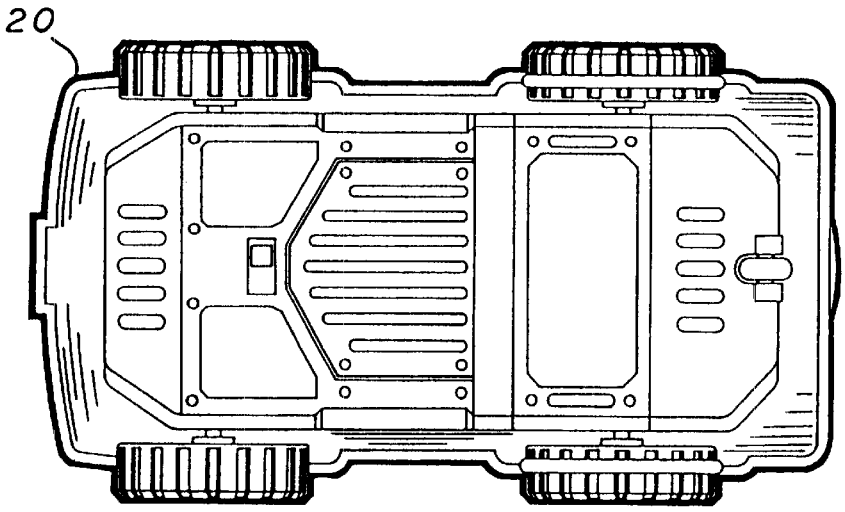

FIG. 37

| EVENT | PATTERN |
|---|---|
| WAIT FOR INPUT | |
| RUN PROGRAM | |
| DEMO 1 | |
| DEMO 2 | |

FIG. 38

| ACTION | PATTERN |
|---|---|
| FORWARD | |
| TURBO FORWARD | (FASTER) |
| TURN 90° | |
| TURN 180° | |

FIG. 39

| EVENT | PATTERN |
|---|---|
| TURN 270° | |
| TURBO START | |
| ROTATE | |
| TURBO ROTATE | (FASTER) |
| POLYGON SHAPE | |
| VIBRATE | |
| CIRCLE | |
| ZIG-ZAG LINE | |
| PAUSE | |

| EVENT | PATTERN |
| --- | --- |
| WAIT FOR INPUT |  |
| START GAME |  |
| HIT TARGET 3 OR 5 TIMES |  |
| MISS TARGET 3 OR 5 TIMES |  |

PROGRAMMABLE TOY AND GAME

RELATED APPLICATION

This invention relates to application Ser. No. 09/008,378, filed Jan. 16, 1998, entitled PROGRAMMABLE TOY. The contents of that application are incorporated by reference herein.

BACKGROUND OF THE INVENTION

This invention relates to a programmable system for enabling an object, preferably a toy or novelty item, to perform a series of movable actions chosen by a user, and, additionally, for the toy to be usable as a game of skill.

Many toys or novelty items are available in the market which can perform different actions instructed by a player through the use of a remote control device. Typically the use of the remote control device results in a specific action of a toy object, for instance a vehicle. The remote control systems are either infrared, or radio controlled and can only be used to instruct the vehicle to perform individual or separate actions. These kinds of actions can be associated with movement of the toy.

There are also available many different kinds of games which are relatively stationary and which constitute games of skill in the hands of the operator.

Having a variable programmable toy or novelty item which has the features of a movable toy and which also has elements of a game of skill would have distinct advantages and benefits in the consumer market.

The invention is directed to overcoming the limitations of existing toys, novelty items and games.

SUMMARY OF THE INVENTION

The invention provides for an interactive programming system for a toy or novelty item. A user, by pressing appropriate keypad buttons can program or instruct an object to perform a series of preset actions. These actions are preset in that different keys are programmed in a first mode to operate or effect different movable actions of the toy or novelty item. Additionally, in a second mode, further programming enables the toy to act as a game of skill, with or without movement. In either mode the operation can, preferably, be accompanied by selected sound effect and light reactions.

According to the invention the programmable toy includes a body which has a motor for actuating a motion generator which can be in the form of wheels or other devices. In a first mode this causes the body to move through the surrounding environment. There is a keypad which operates a series of control switches for operation by the user of the toy. The switches are connected to a programmed or programmable microprocessor for translating the received signals from the switches into control signals for operating the motor. The motor can thereby be caused to activate the body in different selected directions according to the action of the motor on the motive generator.

There is a multipurpose indicator, preferably, in the form a series of light emitting diodes (LEDs) arranged in a predetermined manner to indicate to a user which of a selected program is functional in the first mode of operation. This indicator is a visually responsive device.

The indicator LEDs also operate in a second mode of the system when the toy or novelty item is acting as a game of skill. In the second mode, selected switches operate through a selected program to activate the LEDs according to the skill exhibited by the operator in activating the skill game. One or more of the LEDs can act as one or more selected targets which an operator needs to reach by using the switches appropriately. In the second mode, the body is not intended to operate to effect motion on a surface but rather is intended to be hand-held as the operator activates the switches. Vibration effects can take place in the second mode.

In a preferred form of the invention there is a microprocessor which includes a memory function with which predetermined instructions for action and sound effects can be stored. The activities and objects to perform the action and sound effects are determined as selected by the user. The microprocessor operates to move the movable toy through the motive means in the first mode and to permit the game of skill with the LEDs in the second mode. The programming system is driven by an integrated circuit chip which is responsive to the different keys.

The toy comprises in a first form a single motor programmable car. By pressing the appropriated keypad buttons mounted on the exterior of the car, the operator programs the action of the vehicle. There is also the ability to produce sound effects and a display panel with LEDs gleams according to the motion of the car. The LED display panel also creates a movement pattern appropriately with the action of the car when operating in the first mode, and matching the same pace of operation in the first mode. The integrated circuit chip is responsive to the different keys that drives the programmable system, of the toy in its first mode.

In the second mode the toy constitutes an LED responsive game of skill in the nature of a hand-held game. These games include preferably multiple shooting games set in multiple different levels. Each game is preset. There are different LED gleams and movement patterns to represent different games.

The invention is further described with reference to the accompanying drawings.

BRIEF DESCRIPTION OF THE DRAWINGS

FIG. 6 is a top view of a second embodiment of the invention, namely a van.

FIG. 7 is side view of the van.

FIG. 8 is a bottom view of the van.

FIG. 11 is a top view of third embodiment of the invention, namely a scout vehicle.

FIG. 12 is a side view of the scout vehicle.

FIG. 13 is a bottom view of the scout vehicle.

FIG. 16 is a top view of a third embodiment of the invention, namely a chaser vehicle.

FIG. 17 is a side view of the chaser vehicle.

FIG. 18 is a bottom view of the chaser vehicle.

FIG. 37 is a schematic where the toy is in the first mode and the LEDs gleam to illustrate different events.

FIG. 38 is a schematic where the toy is in the first mode and the LEDs gleam to illustrate different actions and patterns of travel.

FIG. 39 is a schematic where the toy is in the first mode and the LEDs gleam to illustrate different actions and patterns of travel.

DETAILED DESCRIPTION OF THE PREFERRED EMBODIMENT

Figure 1:
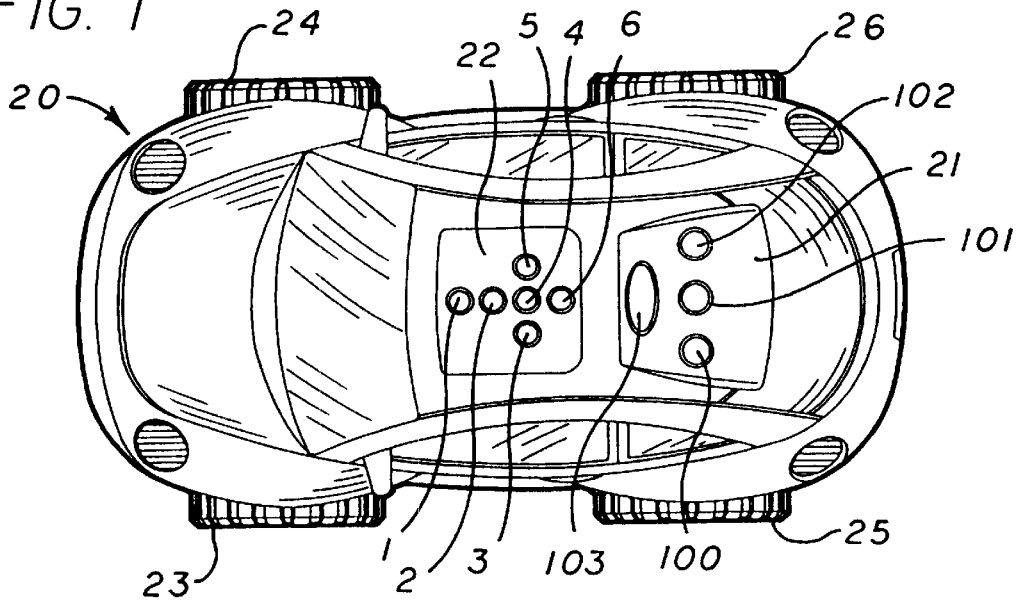
FIG. 1 is a top view of a first embodiment of the invention, namely a car.
Figure 2:
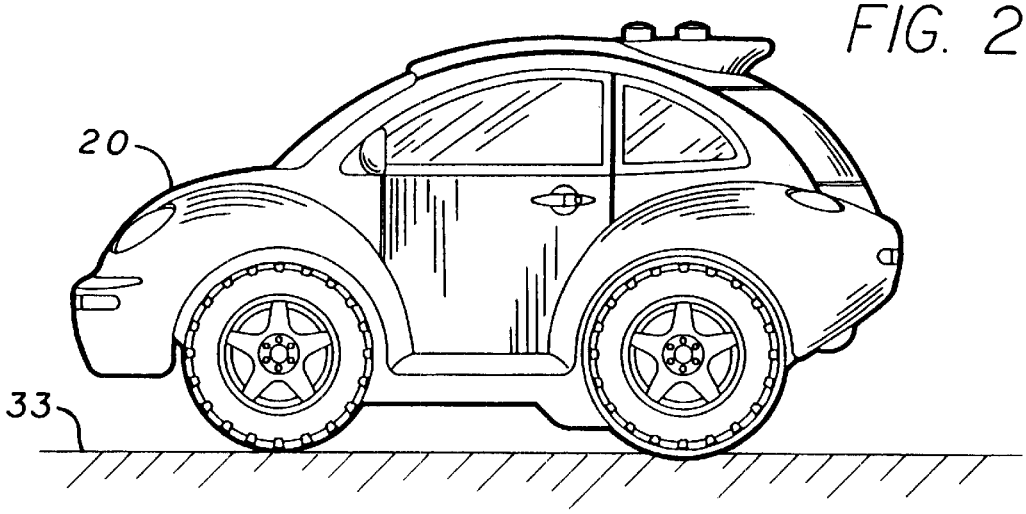
FIG. 2 is a side view of the car.
Figure 3:
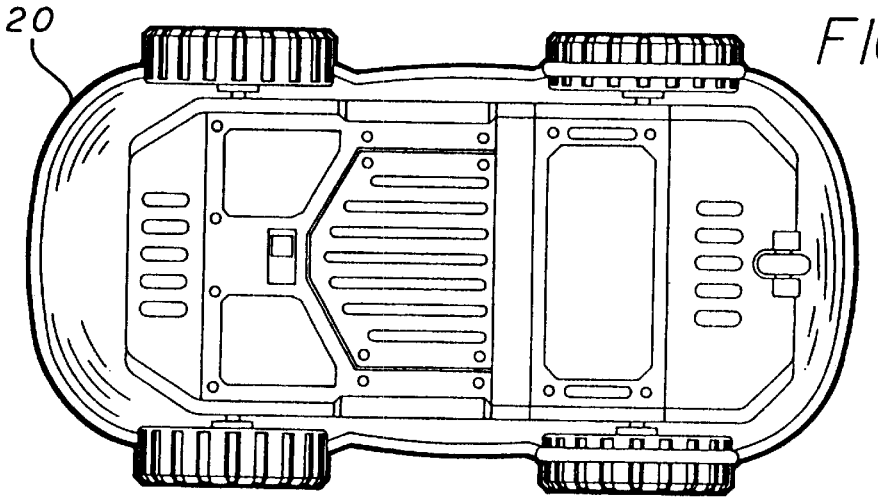
FIG. 3 is a bottom view of the car.
Figure 4:
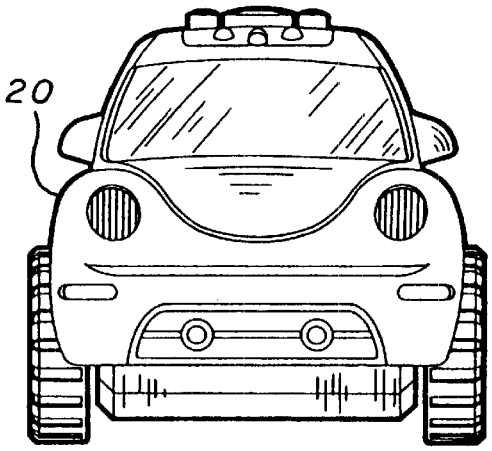
FIG. 4 is a front view of the car.
Figure 5A:
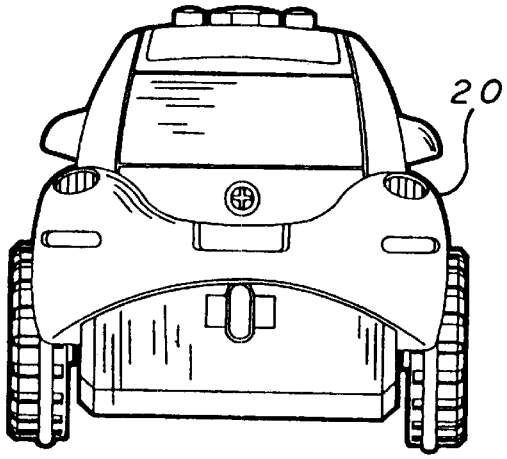
FIG. 5*a* is a rear view of the car.
Figure 5B:
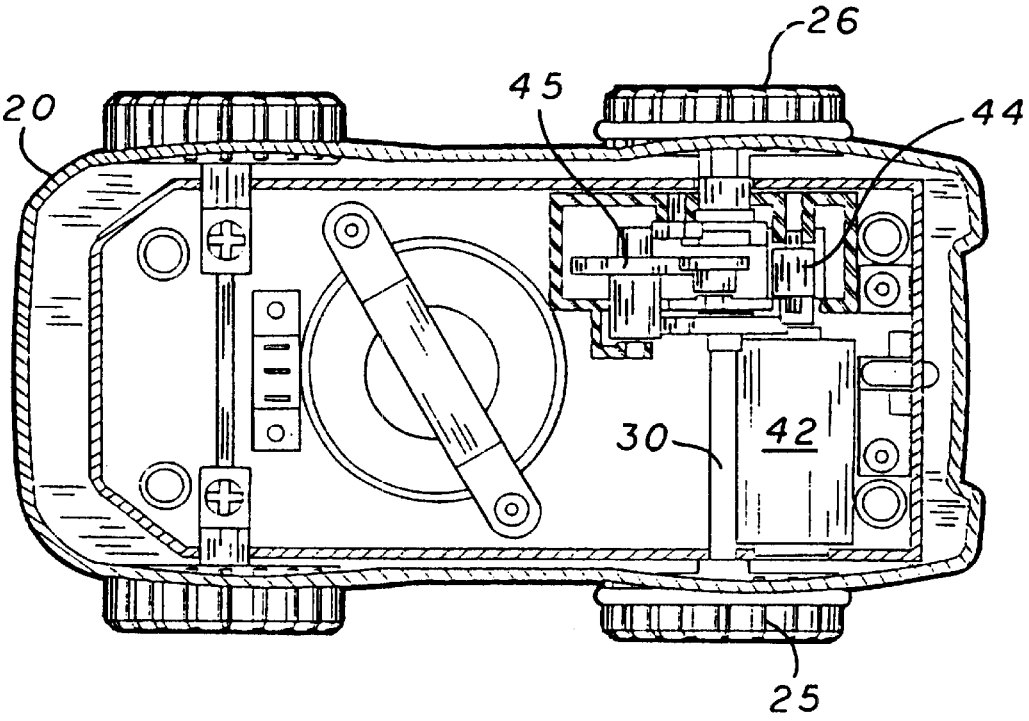
FIG. 5*b* is a sectional side view of the car showing the various mechanisms for driving the car and the elective control system.
Figure 5C:
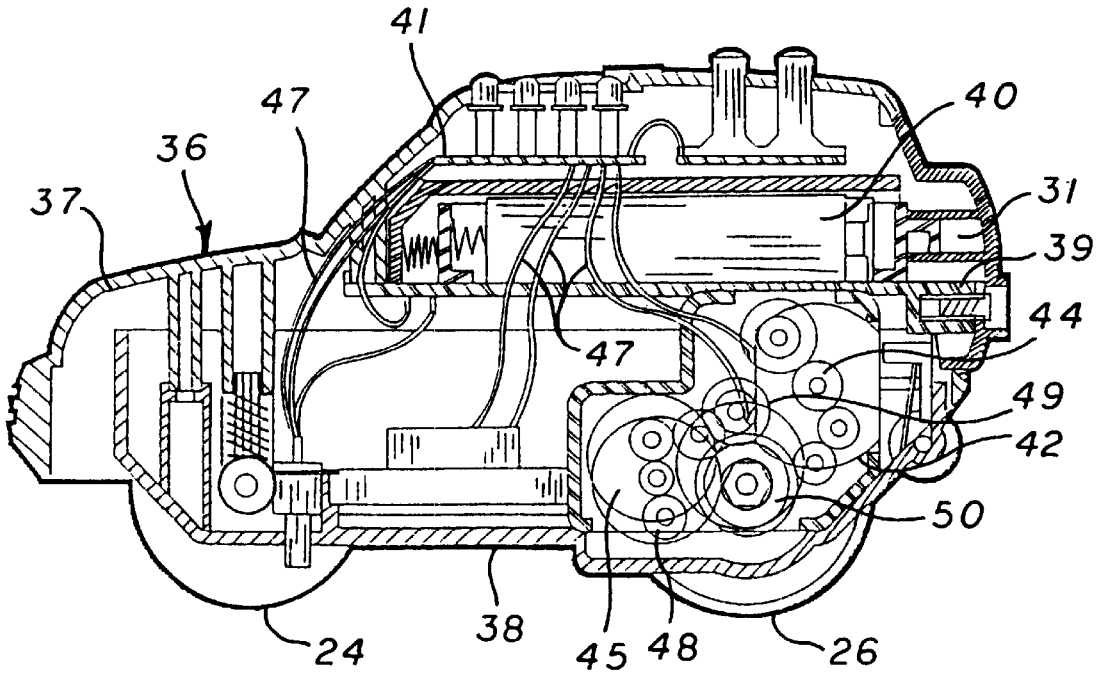
FIG. 5*c* is a sectional top view of the car showing the drive motor for driving the rear wheels of the car.
Figure 9:
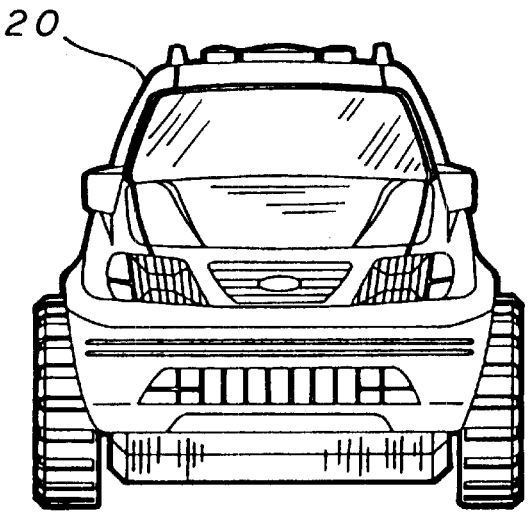
FIG. 9 is a front view of the van.
Figure 10:
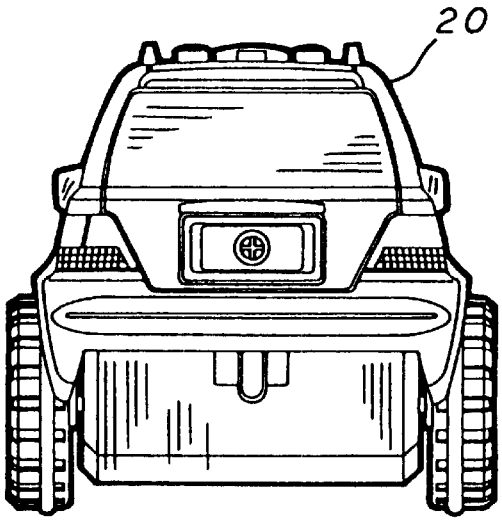
FIG. 10 is a rear view of the van.
Figure 14:
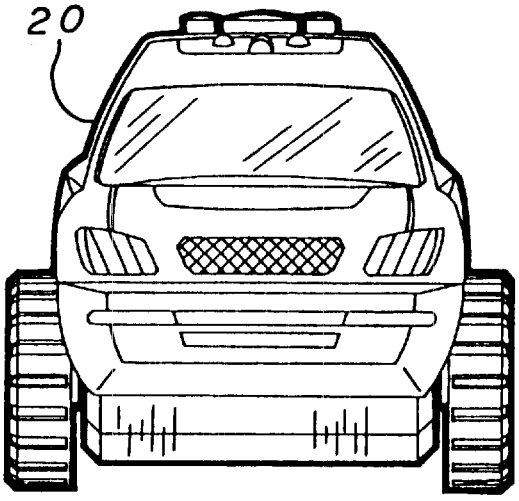
FIG. 14 is a front view of the scout vehicle.
Figure 15:
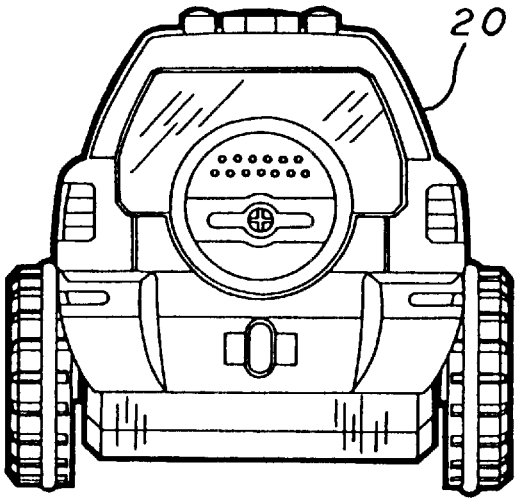
FIG. 15 is a rear view of the scout vehicle.
Figure 19:
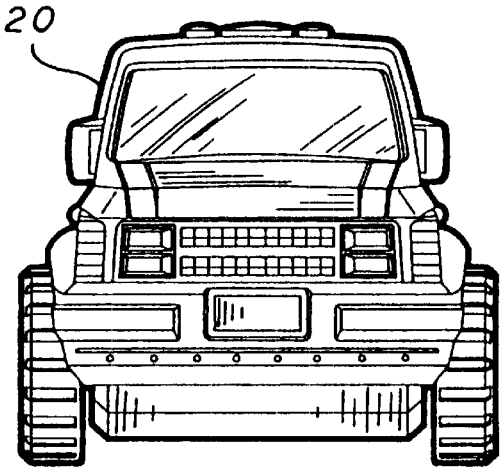
FIG. 19 is a front view of the chaser vehicle.
Figure 20:
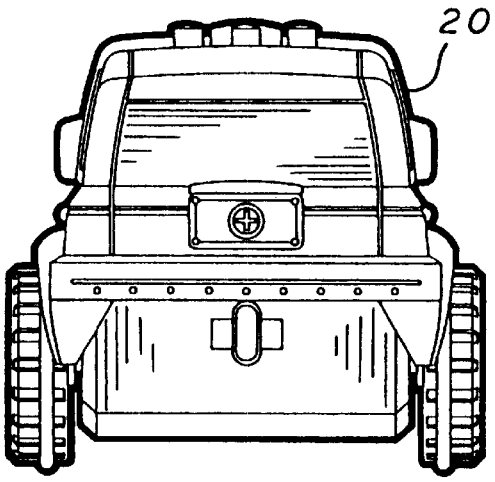
FIG. 20 is a rear view of the chaser vehicle.
Figure 21:
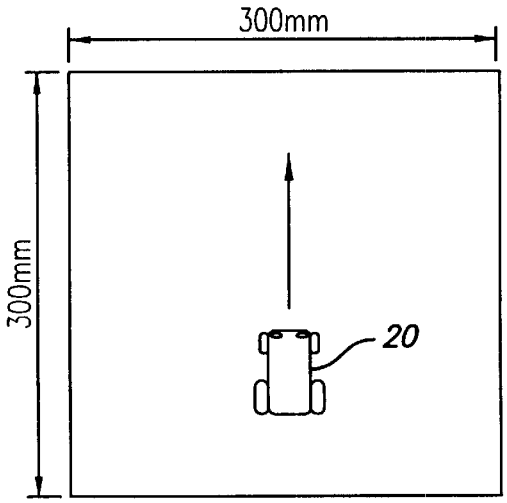
FIG. 21 is a view of the car showing a forward motion.
Figure 22:
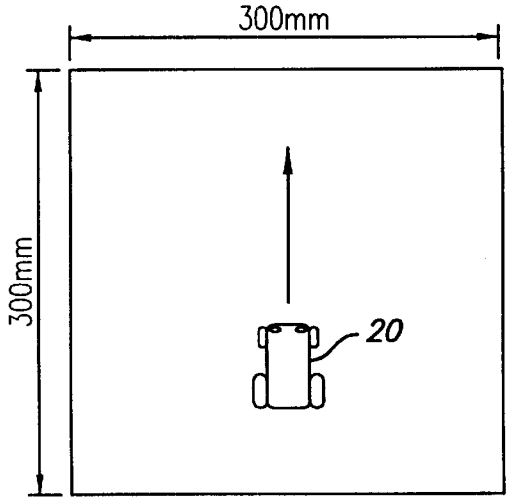
FIG. 22 is a view of the car showing a turbo forward motion.
Figure 23:
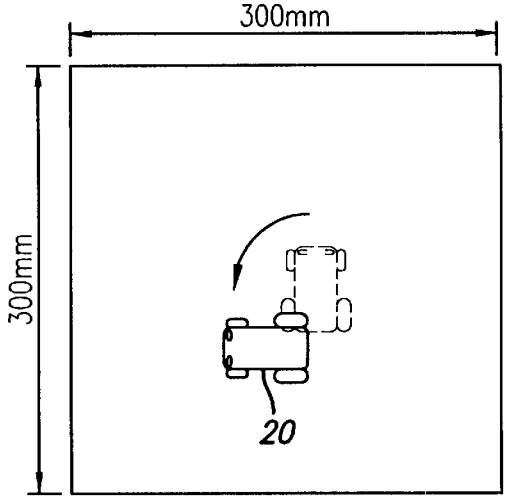
FIG. 23 is a view of the car showing a 90 degree left turn motion.
Figure 24:
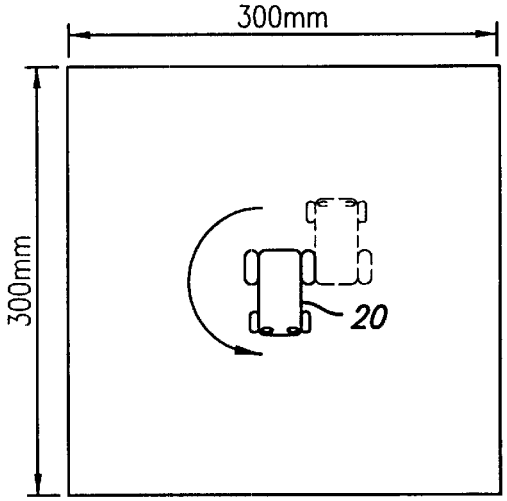
FIG. 24 is a view of the car showing a 180 degree left turn motion.
Figure 25:
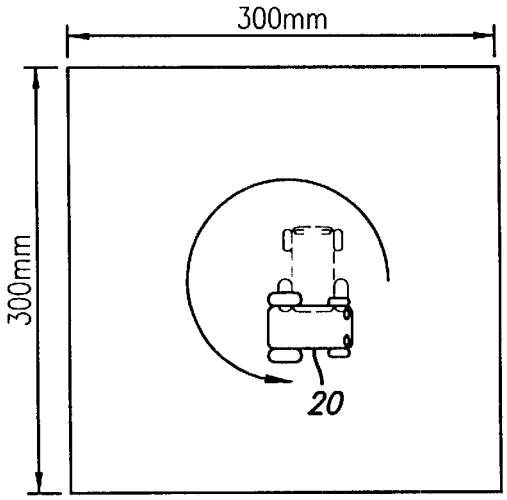
FIG. 25 is a view of the car showing a 270 degree left turn motion.
Figure 26:
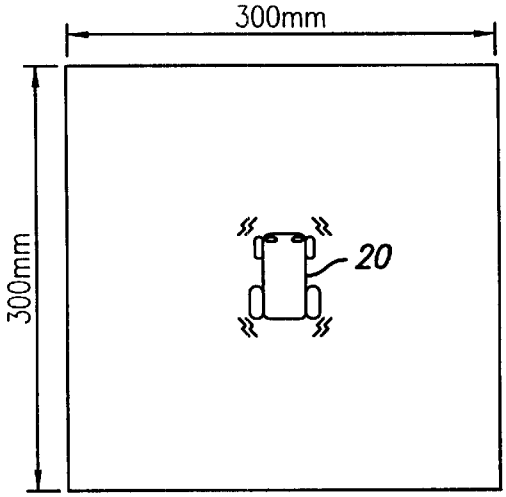
FIG. 26 is a view of the car showing a vibration motion.
Figure 27:
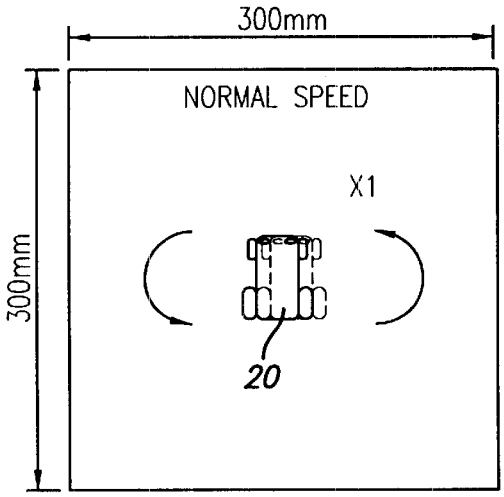
FIG. 27 is a view of the car showing a normal speed rotation motion.
Figure 28:
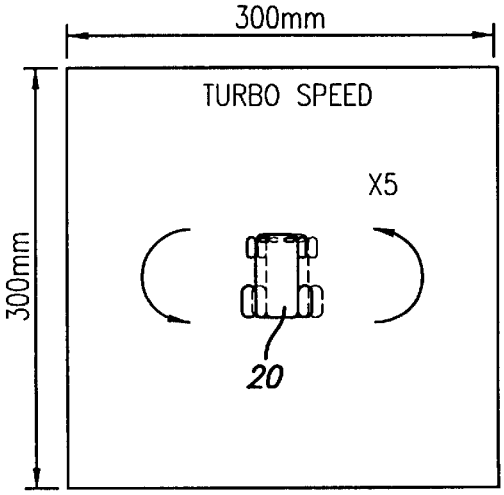
FIG. 28 is a view of the car showing a turbo rotation motion.
Figure 29:
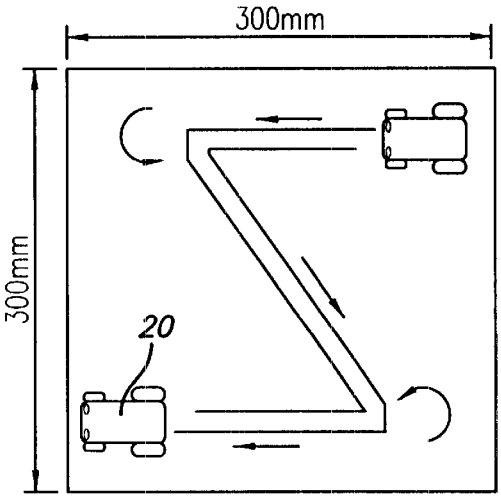
FIG. 29 is a view of the car showing a Z drive motion.
Figure 30:
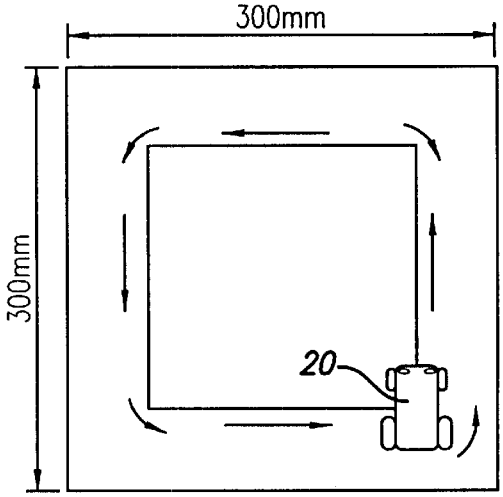
FIG. 30 is a view of the car performing a polygon turn.
Figure 31:
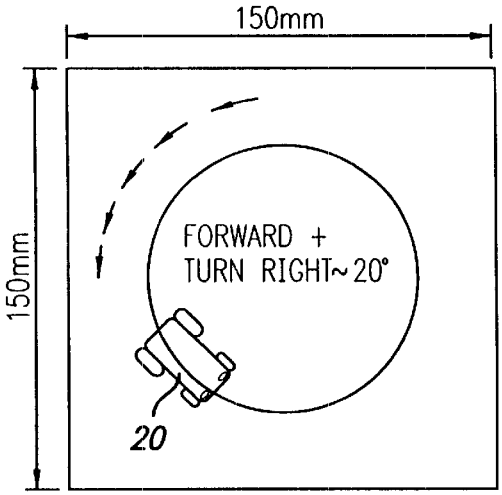
FIG. 31 is a view of the car in a forward and turning right at approximately 20 degrees motion.
Figure 32:
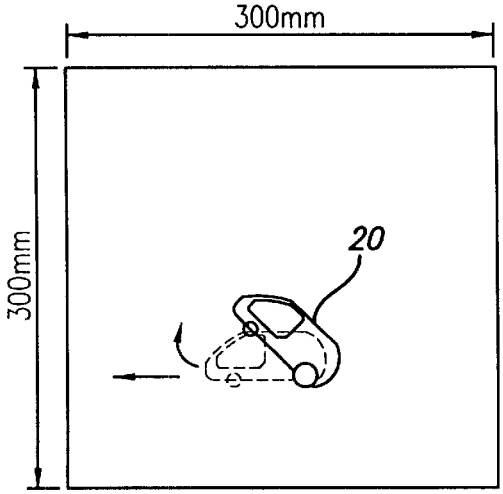
FIG. 32 is a view of the car in a turbo start motion, and set up to pop-wheel.

The invention is illustrated in relation to a car, van, scout and chaser vehicles.

A vehicle 20 is shown with a keyboard 21 mounted on the top of the vehicle 20. There are four switches in the keyboard 21. There are also LED indicators 22 located in front of the keyboard 21. There are four spaced wheels, namely, front wheels 23 and 24 in the front of the vehicle 20 and rear wheels 25 and 26 in the rear of the vehicle 20. Wheels 25 and 26 are driven respectively by a single motor in a manner that will be described more fully below. The keyboard or keypad 21 includes one row of three switches 100, 101 and 102 and another switch 103 ahead of the row.

The rear of the vehicle includes a pattern compartment 31, which has a door, and into which several batteries can be located. The battery compartment 31 can be opened through a door switch or lock, which is appropriately turned to provide access or closure to the battery compartment 31.

The operation of the vehicle is such that it can move on the surface 33 in a forward, rearward, left turn, right turn, rotational, or zigzag direction with slower or faster speeds as programmed into the vehicle 20. The vehicle can also vibrate under the action of the microprocessor on the motor or do a pop-wheely, namely tip up on the rear. These movements are illustrated further in FIGS. 21 through 32.

The front wheels 23 and 24 are mounted on a suspension mechanism 34 with a suitable helical spring 35. The shell of the body is shown as numeral 36, and can be cast as plastic having an upper portion 37, which can be screw connected with a lower portion 38. Within the molded plastic components, there are support elements which can form the structure of the internal workings of the car. This includes a floor 39 for the battery compartment 31.

At least one battery 40 is shown in the battery compartment 31. Mounted ahead of the battery compartment 31, there is a circuit board 41 which has in part the control circuit to drive a motor 42. Motor 42 is operational through a gear wheel mechanism 44 to operate the wheel single 26, and is operational through a gear wheel mechanism 45 to operate the wheel 25. Power from the control board 41 is directed through a series of conducting cables 47 to the motor, and in turn, the gear mechanisms. Gear mechanisms 44 include at least three interlocking gears 48, 49, and 50, which activate the wheel 26. A similar gear system 45 is applicable for wheel 25. A shaft 30 connects the two sets of gears 44 and 45.

In FIGS. 6 through 10, there are different views of a vehicle in the shape and form of a van. The characteristics of this vehicle are similar to that of the car which is illustrated in FIGS. 1 through 5*c*. The outside appearance of the van however, is different and typical of what is a van.

In FIGS. 11 through 15, there is illustrated a scout type vehicle which operates on the same principles. There is the same keypad and arrangement of LEDs on the roof of the vehicle. The operational functions of this scout vehicle are similar to that of the car in FIGS. 1 through 5*c*. In FIGS. 16 through 20, there is shown a representation of a chaser vehicle. This vehicle similarly has a keyboard and LED display on the roof of the vehicle. The operational characteristics are similar to that of the car described in FIGS. 1 through 5*c*.

Figure 33:
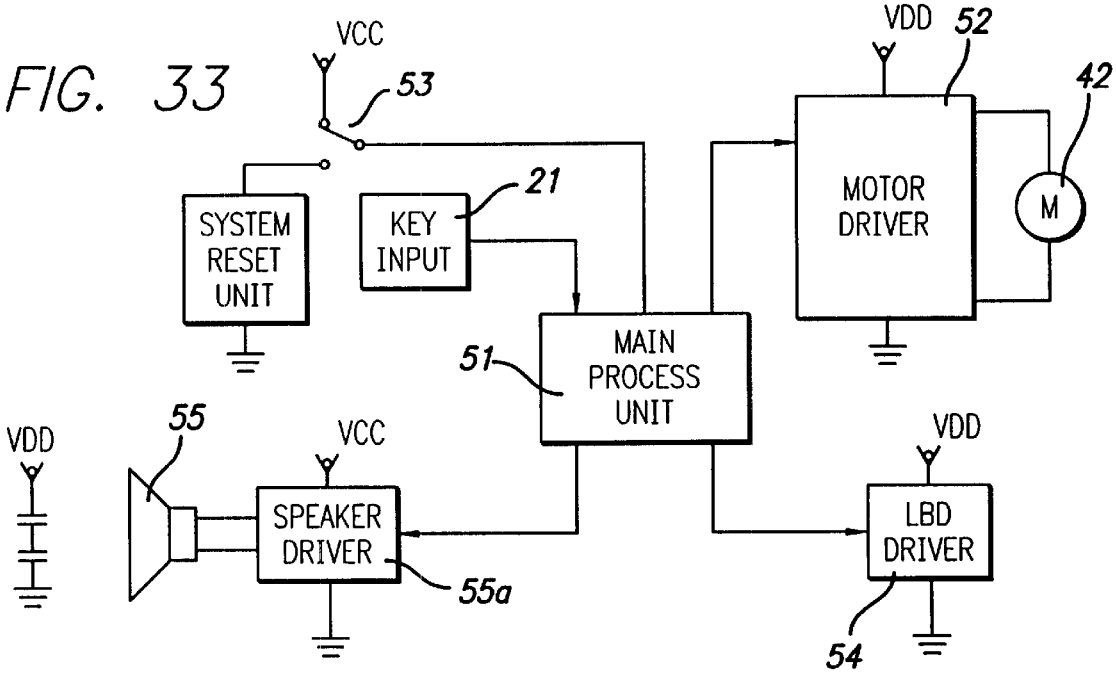
FIG. 33 is a circuit block diagram illustrating the main components of the control units and the microprocessor main control unit.

In FIG. 33, there is shown a main control unit or microprocessor 51 connected with a motor drive control unit 52. The ON/OFF switch for the motor is represented in FIG. 33 by numeral 53, and the keyboard 21 is also shown connected to the microprocessor main control unit 51. The keyboard switches are press button elements which close circuits in the keyboard configuration 21 as shown. The microprocessor also controls a light source LED driver control unit 54, which is operational under given programmed conditions of the processor 51. There is also a speaker 55 which is operational through the speaker drives 55*a* under the control of the microprocessor 51.

The control circuit and microprocessor would use, for instance, transistor pairs for the driver circuits. The microprocessor 51 would have multiple inputs and outputs. The inputs come from the key pad input, and the outputs are driven by the microprocessor 51.

An Exemplary Description of the Vehicle

The main keys in the keyboard 21 have the following function Four function keys:

| | |
|---|---|
| Key-1/Go | (Key 103) |
| Key-2/Shift | (Key 100) |
| Key-3/Enter | (Key 101) |
| Key-4/Select | (Key 102) |

The "Shift" key is pressed two times, and the "Go" key is pressed within 1.5 sec. This permits the control to change to the Drive Mode or Game Mode.

Drive Mode (the first mode)

The Key 1, Key 3, and Key 4 can be activated on their own, or together with the key 2. This provides the following combination of conditions under the Drive Mode.

| Keys | Normal | Shift |
|---|---|---|
| Key-1 Go | Run/Stop | Demo 1/2 |
| Key-2 Shift | Nil | — |
| Key-3 Enter | Confirm Step | Delete Last Step |
| Key-4 Select | Select Next Function | Call Last Program |

Game Mode (the second mode)

In the Game Mode, Keys 1, 3 and 4 cause different conditions to be effected.

| Keys | Normal |
|---|---|
| Key-1 Go | Start/Pause |
| Key-2 Shift | Nil |
| Key-3 Enter | Shooting |
| Key-4 Select | Select Next Game |

The vehicle 20 also includes the On/Off Switch, six LEDs, 22, and the loud speaker 55.

An illustration of the operation of the vehicle in the first mode is set out. There can be a Demo action and two preset operation action programs.

Operational Description (the first mode)

Normal Drive

Once the vehicle is turned on, the LEDs are activated and gleam in a light pattern to indicate normal drive. By pressing the "Select" key, the operator picks the favorable action. There are 13 different actions. These actions are illustrated in FIGS. 21 through 26 respectively.

| Sequence | Action |
|---|---|
| 1 | Forward |
| 2 | Turbo Forward |
| 3 | Turn Left 90 |
| 4 | Turn Left 180 |
| 5 | Turn Left 270 |
| 6 | Turbo Start |
| 7 | Rotate |
| 8 | Turbo Rotate |
| 9 | Polygon |
| 10 | Vibration |
| 11 | Circle |
| 12 | Z-Drive |
| 13 | Pause |

The Select-key 102 also allows the player to store a player-selected designed program for upto a sequence of a maximum of 32 steps. "Demo 1 and/or Demo 2" can also be included as one of the steps. Pressing the "Enter" key confirms the input, and then pressing the "Go" key causes the vehicle to begin its motion. Actions with the appropriated sound effects and LED patterns react accordingly. The "Call Last Program" key recalls the last program.

If 32 steps have not been used up, the player can add some more steps. Pressing the "Enter" key confirms this. Alternatively, should 32 steps have already been used or any step is found not good, "Key-3"+"Shift" is used to delete the last step or the whole sequence. Other actions can then be added. Pressing the "Enter" key confirms this.

To enter the "Game" mode, (the second mode), the "Shift" key is pressed 2 times, followed by the "Go" key. The last program is deleted when the operator starts playing the game. Should the player not have started playing the game, and should the "Shift" key be operated, the system is set back to "Drive" mode. The last program remains there.

Operational Description (the second mode)

Game Mode

After pressing "Shift" key 2 times, followed by the "Go" key within 1.5 sec. the player enters the "Game" mode. There are 3 games with 3 different levels in terms of speed.

| | | |
|---|---|---|
| Game 1 | -Shooting I | LEDs 22 gleam in clockwise direction |
| Game 2 | -Shooting II | LEDs 22 gleam at random |
| Game 3 | -Shooting III | LEDs 22 gleam at random |

Pressing the "Select" key selects the game.

Pressing the "Enter" key confirm the selected game.

Pressing the "Go" key starts playing the game.

The "Enter" key is used as the shooting key.

Shooting I & II

Each game has three levels of different speed and each starts from level 1.

For shooting I—LEDs at position 2, 5, 6 & 3 gleam in a clockwise direction.

For shooting II—LEDs at position 2, 5, 6 & 3 gleam randomly.

LED at position 2 is the target.

Pressing the "Enter" key acts to effect shooting.

Every time the target is shot, there is a sound effect through speaker 55 with a vibration action caused by the motor 42 moving in the vehicle 20. When the target is shot three times continuously at level 1 and level 2, there is a special sound effect, and the game is changed to a higher grade of level 2 or level 3 respectively. When the target is shot three times at level 3, there is another special sound effect. The game will still remain in level 3. When shooting fails to reach the target concept, there is a sound by speaker 55 and light effect caused by the LEDs 22. When the shooting continuously fails for three times, there is another special sound effect.

Shooting III

This game also has three levels.

The LEDs 22 at positions 3, 4 and 5 gleam randomly.

Positions 3, 4 and 5 are the targets, and the player can shoot at any target.

To shoot position 3—the "Shift" key is pressed.

To shoot position 4—the "Enter" key is pressed.

To shoot position 5—the "Select" key is pressed.

Every time the target is shot, there is a sound effect with a vibration action. When the target is shot five times at level 1 and level 2 continuously, there is a special sound effect.

The game is then changed to a higher grade of level 2 or level 3, respectively. When the target is shot five times at level 3, there is another special sound effect. The game still remains in level 3. Should any shooting fail, there is a sound and light effect. Should shooting five times continuously fail, there is another special sound effect.

Example of Operating the Car (first mode) and Playing the Game (second mode)

Demo & Simple Program

| Demo key-in method | Action |
|---|---|
| Shift + Go – Enter + Go | Demo 1 |
| Shift + Go Go – Enter + Go | Demo 2 |

Driving the Car (first mode)

1. Use the Select key to select an action first;
2. Press Enter to input the action;
3. Repeat step 1 and 2 to input more actions;
4. Press Go to run the program.

Playing the Shooting Game—Game of Skill (second mode)

1. Press Select Select Go to change to Game mode;
2. Press Select to select Game 1, 2, or 3;
3. Press Go to start the game;
4. Press Enter to shoot in Game 1 and 2;
5. Press Shift/Enter/Select to shoot in Game 3;
6. Press Go to quit the game before selecting another game or to change to Drive Mode.

Figure 34:
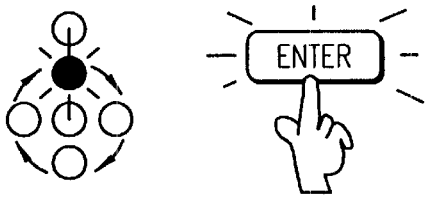
FIG. 34 is a schematic illustrating a first game where the target rotates clockwise in various speeds.
Figure 35:
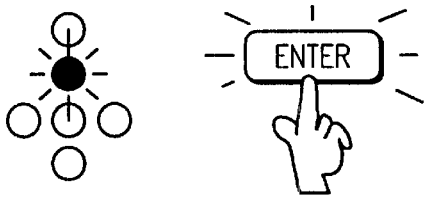
FIG. 35 is a schematic illustrating a second game where the target moves randomly on a circle.
Figure 36:
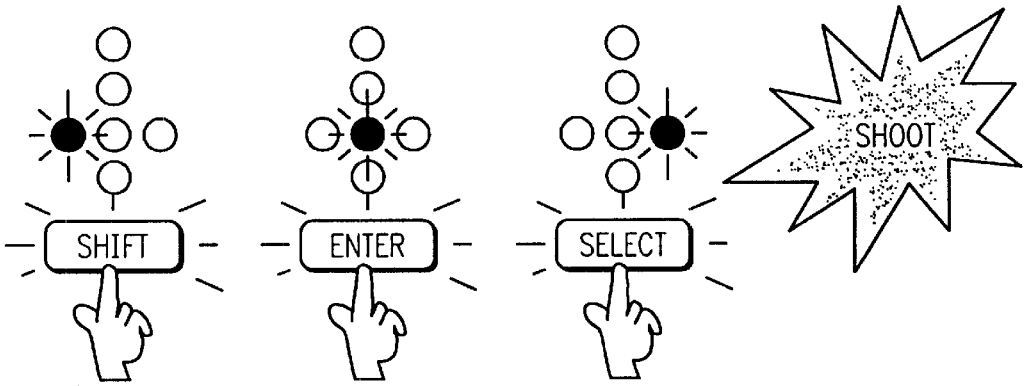
FIG. 36 is a schematic illustrating a third game where the target moves randomly along a horizontal line.

In Game 1 and Game 2, there is a fixed position from which to shoot the target. In Game 3, there are three different positions from which to shoot the target. In game 1, the target rotates clockwise in various speed as shown in FIG. 34. In game 2, the target moves randomly along the circle as shown in FIG. 35. In game 3, the target moves randomly along the horizontal line as shown in FIG. 36.

Exemplary LED Pattern For the Drive Mode

Figure 40:
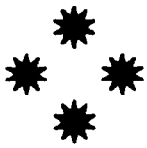
FIG. 40 is a schematic where the toy is in the second mode and the LEDs gleam to illustrate different events relating to the games of skill.
Figure 40:
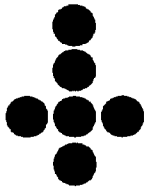
Figure 40:
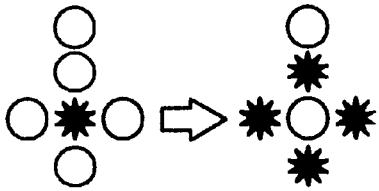
Figure 40:
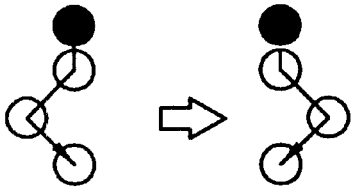

The Drive Mode event is shown in FIG. 37 which shows the Wait for input, Run Program, Demo 1 and Demo 2. The Drive Mode action is shown in FIG. 38 which shows the Forward, Turbo Forward, Turn 90 degrees and Turn 180 degrees motions. The Drive Mode action is shown in FIG. 39 which shows the Turn 270 degrees, Turbo Start, Rotate, Turbo Rotate, Polygon, Vibrate, Circle, Zig-Zag line, and Pause motions. The Game Mode event is shown in FIG. 40 which shows the Wait for input, Start Game, Hit target 3 times, and Miss target 3 times for two of the games. In a third game, there is a hit target 5 times and miss target 5 times for that game.

Many other forms of the invention exist each differing from others in matters of detail only.

Although the invention has been described with reference to a four-wheeled automobile vehicle, it is clear that the invention also has application to other devices such as different toys or novelty items. The kind of toys could be a ship, plane, robot, different kind of automobile such as a three-wheeler, or a motor bike. The surrounding environment would be appropriately a surface, or could be the water in the case of a ship, or air in the case of a plane. In the case of a ship, boat, or plane, the motive generator can be a propeller or screw device.

In some situations, the programming can be effected remotely and be communicated by radio or infrared control. In other situations, although the invention is described as operating with LEDs, it is possible that other light reacting elements could be used, for instance there could be a suitable liquid crystal display with elements responding according to the operation of the switches activated by the keypad.

The invention is to be determined solely by the following claims.

What is claimed is:

1. A programmable device comprising:

a body;

a motor for activating a motive generator on the body for causing the body to move relative to a surrounding environment;

a keypad including a series of control switches for operation by a user;

a series of lights on the body; and the switches being connected with a microprocessor for translating signals received from the switches selectively, in a first mode, into control signals for operating the motor whereby the body is caused to move in different directions according to the action of the motor on the motive generator; and in a second mode, into signals for engaging a game of skill wherein the lights on the body react to selective operation of the switches, and wherein the game of skill is played by a player activating selected switches, the game being unrelated to moving the body relative to the surrounding environment, wherein the body is a representation of a vehicle having lights, and having the keypad for the game mounted on the top of the vehicle, the vehicle including an automobile chassis supported by four wheels; and program means for controlling the game of skill using said lights.

2. A device as claimed in claim 1 wherein the microprocessor is programmable so as to permit for a selection of motions including at least one motion of forward, backward, left turn, right turn or a circular direction.

3. A device as claimed in claim 2 including the motion of pop-wheeling, and wherein a center of gravity of the vehicle is located strategically relative to the wheels thereby to permit tipping of the vehicle according to the control of the wheel motion and thereby to permit pop-wheeling.

4. A device as claimed in claim 1 wherein the lights include LEDs for indicating a state of operation of the first mode or the state of operation of the second mode.

5. A device as claimed in claim 1 including a speaker for creating sounds, and means for selectively activating the motion generator at a time to coordinate with sounds from the speaker.

6. A device as claimed in claim 1 wherein the microprocessor is connected to control means for operating the motor, and control means for operating the lights and additionally sounds, the sounds being operable selectively according to a state of operation in the first mode and the second mode.

7. A device as claimed in claim 1 wherein the keypad permits the lights to select, through the microprocessor, at least one of a series of different skill games.

8. A method of operating a programmable device comprising:

activating a motive generator in a body for causing the body to move relative to a surrounding environment;

operating a keypad to activate a series of control switches;

energizing selectively lights on the body; and the switches being connected with a microprocessor for translating signals received from the switches selectively, in a first mode, into control signals for operating the motive generator whereby the body is caused to move in different directions; and in a second mode, into signals for a game of skill wherein the lights on the body react to selective operation of the switches, and wherein the game of skill includes the interaction of a player with the control switches, and a response by the microprocessor as indicated by the lights on the body causes selective different reactions with the switches, and wherein the game of skill is played by a player activating selected switches, the game being unrelated to moving the body relative to the surrounding environment, and including the activation of a light signal as part of the game to move in at least one direction over the body.

9. A method as claimed in claim 8 wherein the body is representative of an automobile vehicle and wherein there are four spaced wheels, and wherein two wheels are driven by a single motor.

10. A method as claimed in claim 9 wherein the microprocessor is programmable so as to permit for a selection of motions including at least one motion of forward, backward, left turn, right turn or circular direction.

11. A method as claimed in claim 9 including a speaker for creating sounds, and means for selectively activating the motive generator at a time to coordinate with sounds from the speaker.

12. A method as claimed in claim 9 wherein the series of lights selectively reacts in relation to the activation of the motive generator.

13. A method as claimed in claim 9 including a speaker for creating sounds, and means for selectively interacting relative to activation of the wheels, the sounds from the speaker.

14. A method as claimed in claim 9 wherein the microprocessor is connected to control means for operating the motor, and control means for operating the lights and a speaker in the body.

15. A method as claimed in claim 9 wherein the keypad permits the operation of multiple controls which is thereby to permit the selection of multiple combinations of motion of the body.

16. A method as claimed in claim 8 wherein the lights include LEDs for indicating a state of operation of the first mode or the state of operation of the second mode.

17. A programmable device comprising:

a body;

a motor for activating a motive generator on the body for causing the body to move relative to a surrounding environment;

a keypad including a series of control switches for operation by a user;

a series of lights on the body; and the switches being connected with a microprocessor for translating signals received from the switches selectively, in a first mode, into control signals for operating the motor whereby the body is caused to move in different directions according to the action of the motor on the motive generator; and in a second mode, into signals for engaging a game of skill wherein the lights on the body react to selective operation of the switches, and wherein the game of skill is played by a player activating selected switches, the game being unrelated to moving the body relative to the surrounding environment, and wherein the body is a representation of a train.

18. A programmable device comprising:

a body;

a motor for activating a motive generator on the body for causing the body to move relative to a surrounding environment;

a keypad including a series of control switches for operation by a user;

a series of lights on the body; and the switches being connected with a microprocessor for translating signals received from the switches selectively, in a first mode, into control signals for operating the motor whereby the body is caused to move in different directions according to the action of the motor on the motive generator; and in a second mode, into signals for engaging a game of skill wherein the lights on the body react to selective operation of the switches, and wherein the game of skill is played by a player activating selected switches, the game being unrelated to moving the body relative to the surrounding environment, and wherein the body is a representation of a plane.

19. A programmable device comprising:

a body;

a motor for activating a motive generator on the body for causing the body to move relative to a surrounding environment;

a keypad including a series of control switches for operation by a user;

a series of lights on the body; and the switches being connected with a microprocessor for translating signals received from the switches selectively, in a first mode, into control signals for operating the motor whereby the body is caused to move in different directions according to the action of the motor on the motive generator; and in a second mode, into signals for engaging a game of skill wherein the lights on the body react to selective operation of the switches, and wherein the game of skill is played by a player activating selected switches, the game being unrelated to moving the body relative to the surrounding environment, and wherein the body is a representation of a motorbike.

20. A programmable device comprising:

a automobile body;

a motor for activating a motive generator on the automobile body for causing the automobile body to move relative to a surrounding environment;

a keypad including a series of control switches for operation by a user;

a series of lights on the automobile body;

the switches being connected with a microprocessor for translating signals received from the switches selectively, in a first mode, into control signals for operating the motor whereby the body is caused to move in different directions according to the action of the motor on the motive generator; the directions including the motion of forward, backward, right turn, left turn and circular; and in a second mode, into signals for engaging a game of skill wherein the lights on the body react to selective operation of the switches;

wherein the automobile body includes lights, and wherein the keypad for the game is mounted on the top of the automobile body, the vehicle including an automobile chassis supported by four wheels; and program means for controlling the game of skill using said lights.

21. A programmable device comprising:

a body;

a motor for activating a motive generator on the body for causing the body to move relative to a surrounding environment;

a keypad including a series of control switches for operation by a user;

a series of lights on the body;

the switches being connected with a microprocessor for translating signals received from the switches selectively, in a first mode, into control signals for operating the motor whereby the body is caused to move in different directions according to the action of the motor on the motive generator; and in a second mode, into signals for engaging a game of skill wherein the lights on the body react to selective operation of the switches;

wherein the motion of the body is not operable under remote control; and wherein the body is a representation of a vehicle having lights, and having the keypad for the game mounted on the top of the vehicle, the vehicle including an automobile chassis supported by four wheels; and program means for controlling the game of skill using said lights.

22. A programmable device comprising:

a vehicle body;

a motor for activating a motive generator on the vehicle body for causing vehicle the body to move on a surface relative to a surrounding environment;

a keypad including a series of control switches for operation by a user;

a series of lights on the vehicle body;

the switches being connected with a microprocessor for translating signals received from the switches selectively, in a first mode, into control signals for operating the motor whereby the body is caused to move in different directions according to the action of the motor on the motive generator; and in a second mode, into signals for engaging a game of skill wherein the lights on the vehicle body react to selective operation of the switches;

the motive of the vehicle body in the first mode including tipping of the vehicle body relative to the surface; and wherein the body is a representation of a vehicle having lights, and wherein the keypad for the game is mounted on the top of the vehicle, the vehicle including an automobile chassis supported by four wheels; and program means for controlling the game of skill using said lights.

* * * * *